United States Patent [19]

Cooper

[11] Patent Number: 5,000,164

[45] Date of Patent: Mar. 19, 1991

[54] CIRCULATION ENHANCING APPARATUS

[75] Inventor: Guy F. Cooper, Ventura, Calif.

[73] Assignee: The United States of America as represented by the Secretary of the Navy, Washington, D.C.

[21] Appl. No.: 374,204

[22] Filed: Jun. 26, 1989

[51] Int. Cl.[5] ..... A61H 7/00; A61H 1/00

[52] U.S. Cl. ..... 128/64; 128/24 R; 128/202.12

[58] Field of Search ..... 128/64, 202.12, 205.24, 128/24 R, 24.1, 24.2, 24.5, 25 B, 32, 38, 40, 44, 89 R, 51, 59, 66

[56] References Cited

U.S. PATENT DOCUMENTS

| | | | |
|---|---|---|---|
| 3,288,132 | 11/1966 | Meredith . | |
| 3,403,673 | 10/1968 | MacLeod | 128/64 X |
| 3,654,919 | 4/1972 | Birtwell | 128/64 |
| 3,824,992 | 7/1974 | Nicholson et al. | 128/64 X |
| 3,835,845 | 9/1974 | Maher | 128/64 |
| 3,859,989 | 1/1975 | Spielberg . | |
| 3,865,102 | 2/1975 | Birtwell et al. | 128/64 |
| 3,865,103 | 2/1975 | Folman . | |
| 3,892,229 | 7/1975 | Taylor et al. . | |
| 3,942,518 | 3/1976 | Tenteris et al. | 128/64 X |
| 4,057,046 | 11/1977 | Kawaguchi | 128/24 R |
| 4,077,402 | 3/1978 | Benjamin, Jr. et al. | 128/24 R |
| 4,167,181 | 9/1979 | Lee | 128/682 |
| 4,205,688 | 6/1980 | Hauser et al. | 128/694 |
| 4,343,302 | 8/1982 | Dillon | 128/24 R |
| 4,370,975 | 2/1983 | Wright . | |
| 4,374,518 | 2/1983 | Villanueva . | |
| 4,493,326 | 1/1985 | Hill et al. | 128/680 |
| 4,590,925 | 5/1986 | Dillon | 128/24 R |
| 4,624,248 | 11/1986 | Poole et al. | 128/89 R |
| 4,702,232 | 10/1987 | Gardner et al. . | |
| 4,738,249 | 4/1988 | Linman et al. . | |
| 4,838,263 | 6/1989 | Warwick et al. | 128/24 R X |

*Primary Examiner*—Richard J. Apley
*Assistant Examiner*—Linda C. M. Dvorak
*Attorney, Agent, or Firm*—David S. Kalmbaugh

[57] ABSTRACT

Blood circulation in an injured human foot is involuntarily promoted in a vacuum over-pressure cycle and in synchronism with the human heart's systolic and diastolic pressure pulsations. In a preferred embodiment, the circulation enhancing apparatus comprises an air tight boot contoured to fit the injured human foot, a pressure modulator for providing over-pressure and vacuum pulses to the boot to enhance blood circulation through the injured foot and a control circuit which monitors the heart's systolic and diastolic pressure pulsations and provides electrical control signals to the pressure modulator to assure that the over-pressure and vacuum pulses are cyclic and in synchronism with the heart's systolic and diastolic pressure pulsations.

19 Claims, 3 Drawing Sheets

CIRCULATION ENHANCING APPARATUS

BACKGROUND OF THE INVENTION

1. Field of the Invention

This invention relates to an apparatus for augmenting blood circulation in a limb of a patient and in particular to a foot or hand subjected to severe frost bite.

2. Description of the Prior Art

Patients exposed to severe frost bite and other forms of injuries or illness that impair blood circulation in an injured limb need enhancement of the blood circulation in order to heal or in an extreme case save the limb and provide for a full recovery. Inadequate arterial blood flow in the injured limb can lead to such problems as pain upon exertion, slow healing of injuries, breakdown of soft tissue leading to slow healing of ulcers and in the extreme, gangrene with the result and need to amputate the injured limb.

Prior art methods of restoring full blood circulation to an injured limb include medication, massaging, and applying warmth to the injured limb. However, these methods are of limited value in treating severe injuries, especially frostbite.

There are also a wide variety of prior art devices designed to assist blood circulation in an injured limb. Examples of such prior art devices include: U.S. Pat. No. 4,374,518 issued to Villanueva on Feb. 22, 1983 which discloses an electronic device for pneumomassage of the limb of a patient which includes a compressor for successively inflating and deflating inner and outer boots in a rhythmic preselected cycle; and U.S. Pat. No. 4,738,249 issued to Linman et al on Apr. 19, 1988 which discloses a device for cyclically subjecting an injured limb to subatmospheric pressure.

While these devices of the prior art are designed to fit an injured limb and provide for increased blood circulation by sending alternate intermittent pressure pulsations to the injured limb to periodically compress and release the leg and accelerate blood flow, these devices of the prior art do not work in synchronism with the patient's heart or nearby artery to increase blood flow into and out to the injured limb.

SUMMARY OF THE INVENTION

It is an object of the invention to provide an improved apparatus for promoting and/or enhancing blood circulation within an injured limb.

A specific object is to achieve enhanced blood circulation by providing pressure pulsations in the order of 80 to 120 millimeters of mercury peak-to-peak in synchronism with the systolic and diastolic pressure pulsations of the patient's heart or supplying artery.

It is also an object of the invention to achieve the foregoing objects with a relatively simple and inexpensive blood circulation enhancement apparatus.

Other objects, advantages and novel features of the invention will become apparent from the following detailed description when considered in conjunction with the accompanying drawings.

DESCRIPTION OF THE PREFERRED EMBODIMENT

Figure 1:
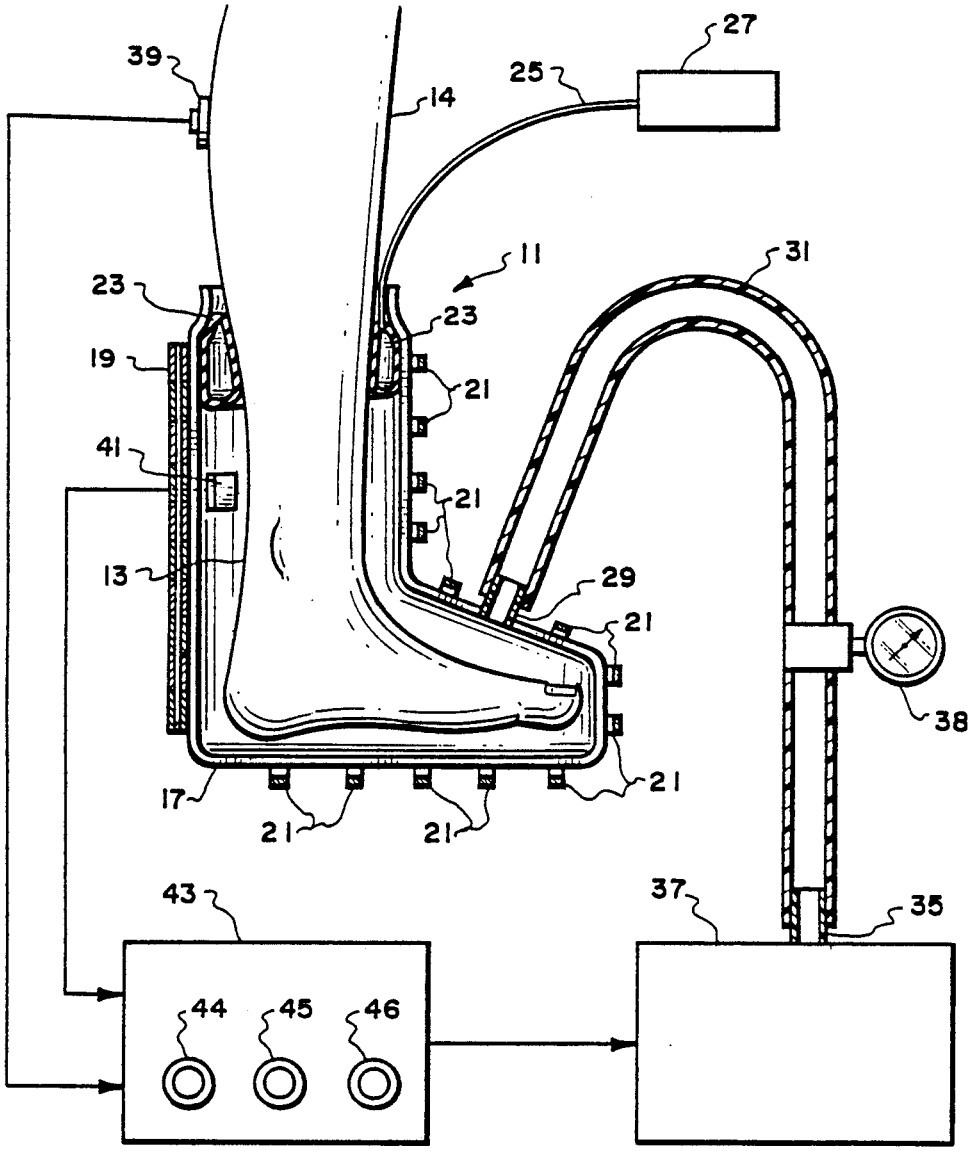
FIG. 1 is a simplified side view of the foot extremity of a leg to which the circulation enhancing boot of the subject invention has been applied.

The preferred embodiment of the subject invention will now be discussed in conjunction with all of the figures of the drawing wherein like parts are designated by like reference numerals insofar as it is possible and practical to do so.

Referring first to FIG. 1, there is shown a circulation enhancing boot 11 that is contoured to and covers an injured human foot 13 and leg 14. Circulation enhancing boot 11 is a sealed cavity surrounding foot 13 and may be fabricated from plastic, fiberglass or plexiglass, if transparency is desired so as to allow observation of injured foot 13.

Figure 2:
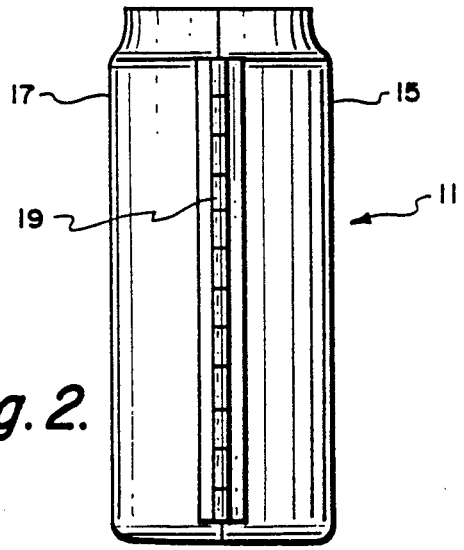
FIG. 2 is a back side view of the circulation enhancing boot of the subject invention.

Referring now to FIGS. 1 and 2, circulation enhancing boot 11 has a pair of halves 15 and 17 joined together by a hinge assembly 19 located on the back side of boot 11 which allows boot 11 to be applied to and removed from injured foot 13. Located on the bottom and front side of boot 11 are a plurality of clasps 21 which hold halves 15 and 17 of boot 11 together while boot 11 is being used on injured foot 13.

Referring again to FIG. 1, there is shown a pneumatic cuff 23 attached to the inner surface of boot 11 at the top of boot 11. Pneumatic cuff 23 has a hose 25 which is connected to a source 27. Source 27 provides fluid, preferably air, to cuff 23 so as to inflate cuff 23 such that cuff 23 completely encircles leg 14 slightly above the ankle and makes an air tight seal about leg 14, but does not restrict the flow of blood through injured foot 13. It should be noted that cuff 23 may be fabricated from rubber or a similar material which conforms to the contour of leg 14. Connected to an inlet outlet port 29 located on boot 11 is one end of a thick walled flexible hose 31 which may be fabricated from one inch inside diameter surgical rubber such that hose 31 will not collapse during the vacuum portions of a pressure cycle. The opposite end of flexible hose 31 is connected to an inlet outlet port 35 located on a pressure modulator 37. Flexible hose 31 also includes pressure gauge 38 which measures fluid pressure above and below ambient pressure in millimeters of mercury.

Attached to leg 14 by adhesive tape is a first pressure transducer 39 which monitors arterial blood pressure variations. Pressure transducer 39 should be placed reasonably close to injured foot 13 preferably on an artery under the knee of leg 14 so as to provide an accurate reading of the injured person's arterial blood pressure variations nearest foot 13. A second pressure transducer 41 is mounted on the inner surface of boot 11 to monitor pressure within boot 11.

The electrical output of transducer 39 is connected to the first input of a control circuit 43, while the second input of control circuit 43 is connected to the electrical output of transducer 41. The output of control circuit 43 is, in turn, connected to the electrical input of pressure modulator 37. Control circuit 43 has mounted thereon a pressure bias potentiometer 44, an artery pressure potentiometer 45, and a boot pressure potentiometer 46. Potentiometers 44, 45 and 46 may be set by an attending physician to insure that the pressure vacuum pulsations provided by pressure modulator 37 are in proper synchronism with the heart's systolic and diastolic pressure pulsations, and that the pressure vacuum pulsations within boot 11 do not go to excessive levels to cause further injury to foot 13.

Figure 3:
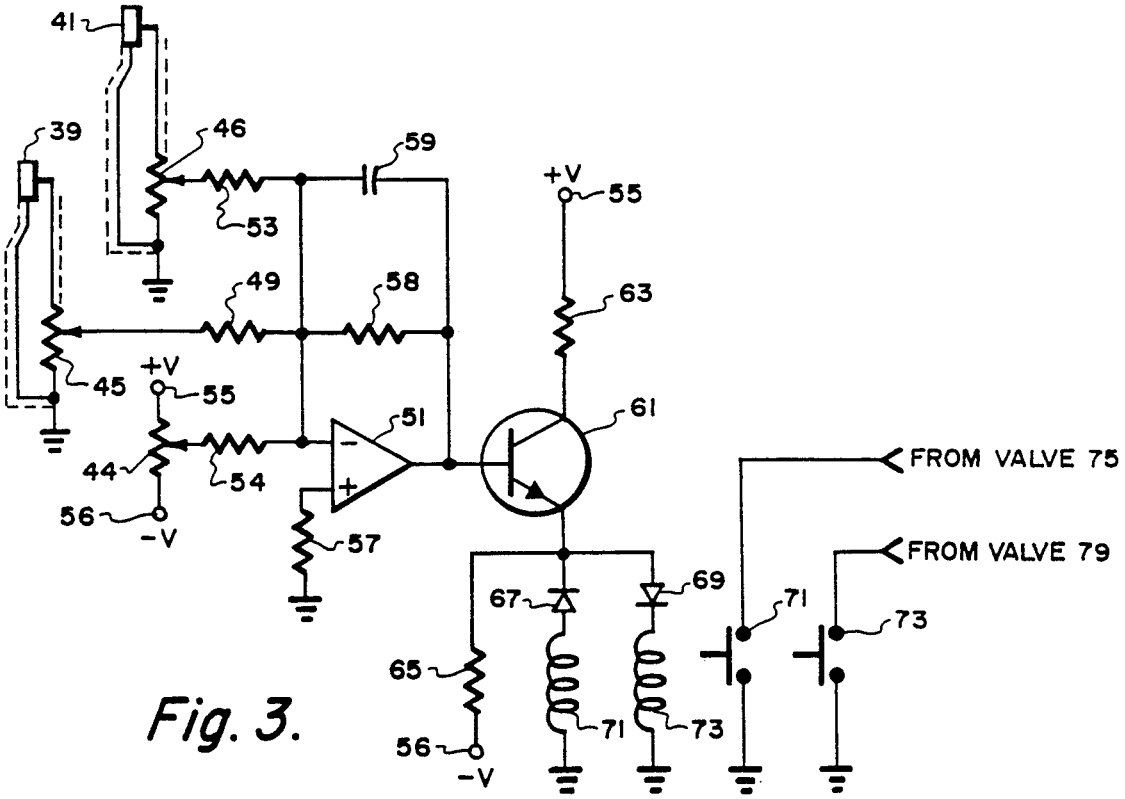
FIG. 3 is an electrical diagram of the control circuit of FIG. 1.

Referring now to FIG. 3, the electrical output of transducer 39 is connected through potentiometer 45 and a resistor 49 to the negative input of an integrating amplifier 51 which may be a Model 741 operational amplifier available from Radio Shack and other suppliers. The electrical output of transducer 41 is connected through potentiometer 46 and a resistor 53 to the negative input of integrating amplifier 51, while pressure bias potentiometer 44 is connected through a resistor 54 to the negative input of amplifier 51. Potentiometer 44 is also connected between a positive direct current voltage source 55 and a negative direct current voltage source 56. Connected between the positive input of amplifier 51 and ground is a resistor 57. For amplifier feedback, there is connected between the negative input and output of amplifier 51 in parallel a resistor 58 and a capacitor 59.

It should be noted at this time that the electrical leads from transducer 39 to potentiometer 45 and from transducer 41 to potentiometer 46 are shielded to prevent noise from distorting the electrical signals provided by pressure transducers 39 and 41.

The output of amplifier 51 is connected to the base of a power amplifier transistor 61, the collector of which is connected through a resistor 63 to positive voltage source 55 and the emitter of which is connected through a resistor 65 to negative voltage source 56, the cathode of a diode 67 and the anode of diode 69. Transistor 61 may be a Model 2N2222 transistor available from Radio Shack and other suppliers. The anode of diode 67 is connected to the coil of a normally open relay 71, while the cathode of diode 69 is connected to the coil of normally open relay 73.

Set forth in the table below are the values of the various components used in the preferred embodiment of control circuit 43.

TABLE 1

| Component | Value |
|---|---|
| Potentiometers 44, 45, 46 | 100 K ohms |
| Resistors 49, 53, 54 | 100 K ohms |
| Resistor 57 | 10 K ohms |
| Resistor 58 | 500 K ohms |
| Capacitor 59 | 10 microfarads |
| Resistors 63, 65 | 47 ohms |

At this time it should be noted that the values selected for resistor 58 and capacitor 59 provide an RC time constant which is appropriate for the approximate time period for a beat of the human heart at rest.

Figure 4:
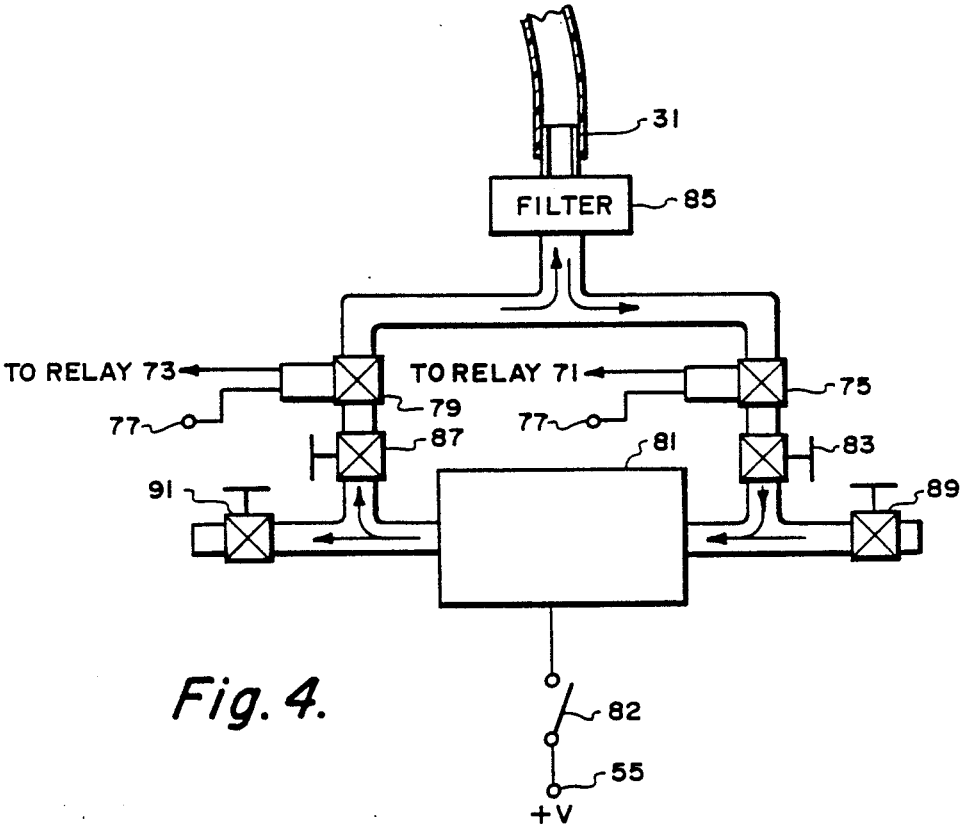
FIG. 4 is a pneumatic diagram of the blower pump of FIG. 1.

Referring now to FIG. 4, there is shown a first normally closed solenoid valve 75, the electrical output of which is connected to the normally open contact of relay 71, FIG. 3, and the electrical input of which is connected to an alternating current power source 77. A second normally closed solenoid value 79 has an electrical output connected to the contact of relay 73, FIG. 3, and an electrical input connected to alternating current power source 77.

The electrical input of a blower pump 81 is connected through a switch 82 to power source 55, while the inlet port of pump 81 is connected through an adjustable fluid flow restricting valve 83 to the outlet port of valve 75. The inlet port of valve 75 is connected through a filter 85 to flexible hose 31 and the outlet port of solenoid valve 79. The inlet port of valve 79 is connected through an adjustable fluid flow restricting valve 87 to the outlet port of blower pump 81. Blower pump 81 also has connected to the inlet port thereof an adjustable fluid flow restricting valve 89 and the outlet port of blower pump 81 is connected to an adjustable fluid flow restricting valve 91.

Valves 89 and 91 function as adjustable pressure regulating orifices for blower pump 81 when blower pump 81 is operational. In the preferred embodiment of the subject invention, blower pump 81 comprised ten muffin fans, stacked in serial Model 6248 manufactured by Papst Mfg. Co., although a household vacuum cleaner blower motor could function as blower pump 81.

The operation of the subject invention will now be discussed in conjunction with all of the figures of the drawings.

Figure 5:
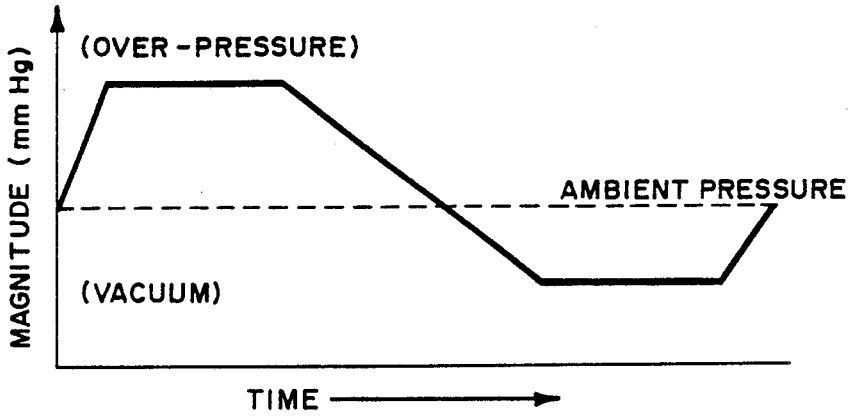
FIG. 5 is a graphical representation of the pressure-vacuum cycle within the circulation enhancing boot of the subject invention.

Referring now to FIGS. 1 and 4 blower pump 81 is activated by closing switch 82. When valve 79 is open and valve 75 is closed blower pump 81 draws air from the atmosphere through valve 89 and forces air through valves 87 and 79 and filter 85 to create in boot 11 the over-pressure condition illustrated in FIG. 5. When valve 79 is closed and valve 75 is open blower pump 81 draws air from boot 11 through filter 85 and valves 75 and 83 and discharges air into the atmosphere through valve 91 thereby creating in boot 11 the vacuum condition illustrated in FIG. 5. By adjusting valves 83, 87, 89 and 91, and obtaining readings using pressure gauge 38, the magnitudes of the peak over-pressure and the peak vacuum during a cycle can be varied to a level desired by the attending physician. Thus, if it is desired, to increase the peak-to-peak magnitude of the over-pressure and vacuum during a cycle because of low artery pressure, adjusting valves 83, 87, 89 and 91 will provide for changes in peak-to-peak magnitude of the over-pressure and vacuum during cycle.

At this time it should be noted gases and liquids other than air may be used with the subject invention.

Referring now to FIGS. 1, 3 and 4, when switch 82 is closed, there is no pressure within boot 11. Transducer 39 will then sense the arteries systolic pressure pulsation phase and provide to the negative input of amplifier 51 a positive analog signal indicative of this pressure pulsation which is inverted by amplifier 51. Amplifier 51 then sums and integrates this signal with the signals provided by Potentiometers 44 and 45 to provide to transistor 61 a negative signal which turns off transistor 61. This, in turn, energizes the solenoid of relay 71, thereby closing the contact of relay 71, and energizing solenoid valve 75, which is now open. Blower pump 81 draws air from boot 11, through valves 75, 83 discharging air into the atmosphere and creating a vacuum within boot 11. The vacuum created within boot 11 will cause blood to flow into injured foot 13 thereby augmenting the effect of the artery's systolic pressure phase.

Transducer 39 will next sense the artery's diastolic pressure and provide to the negative input of amplifier 51 a negative analog signal indicative of this pressure pulsation. Amplifier 51 then sums and integrates this signal with the signals provided by potentiometers 44 and 45 to provide to transistor 61 a positive signal. At this time it should be noted that potentiometers 44, 45, and 46 need to be preset so that a positive signal appears at the negative input of amplifier 51 during the heart's systolic phase and negative signal appears at the negative input of amplifier during the heart's diastolic phase. The positive signal provided by amplifier 51 turns on transistor 61 which energizes the solenoid of relay 73, closing the contact of relay 73 and energizing the solenoid valve 79 which is now open. Blower pump draws air from the atmosphere through valves 89, 87 and 79 and filter 85 into boot thereby creating an over-pressure condition within boot 11 causing blood to flow from injured foot 13 to the heart.

Transducer 41 monitors excessive or prolonged pressure pulses within boot 11. Transducer 41 provides an analog signal to potentiometer 46 which is set such that whenever the analog signal exceeds a predetermined voltage magnitude amplifier 51 turns off transistor 61, energizing the coil and closing the contact of relay 71, and activating solenoid valve 75. Valve 75 is now open allowing blower pump 81 to withdraw air from boot 11, thereby reducing the pressure within boot 11.

Transducer 41 also monitors excessive or prolonged vacuum pulses within boot 11. Transducer 41 provides an analog signal to potentiometer 46 which is set such that whenever the analog signal exceeds a predetermined magnitude amplifier 51 turns on transistor 61, energizing the coil and closing the contact of relay 73, and activating solenoid valve 79. Valve 79 is now open allowing blower pump 81 to force air into boot 11, thereby increasing the pressure within boot 11.

In normal operation the positive pressure signal provided by transducer 41 is small compared to the analog signal provided by transducer 39, and thus will not effect that over-pressure vacuum cycle of boot 11. Adjustment of the magnitude of the signal provided transducer 41 can be made by adjusting potentiometer 46.

Figure 6:
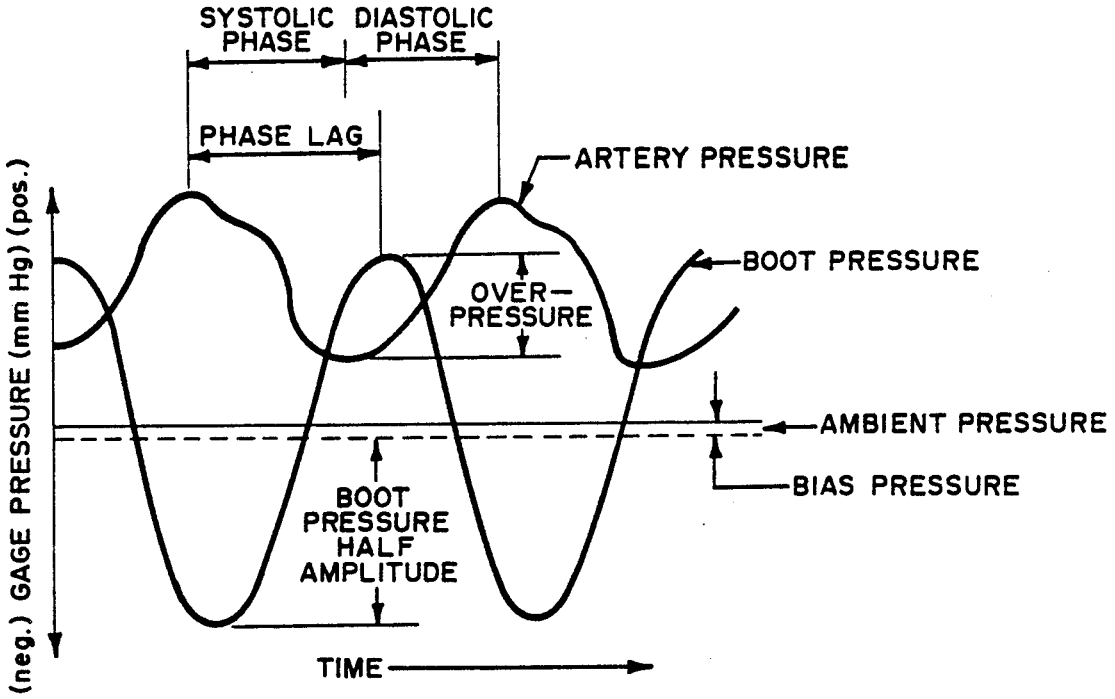
FIG. 6 is a graphical representation of the relationship between artery pressure and the pressure within the circulation enhancing boot of the subject invention.
Figure 7:
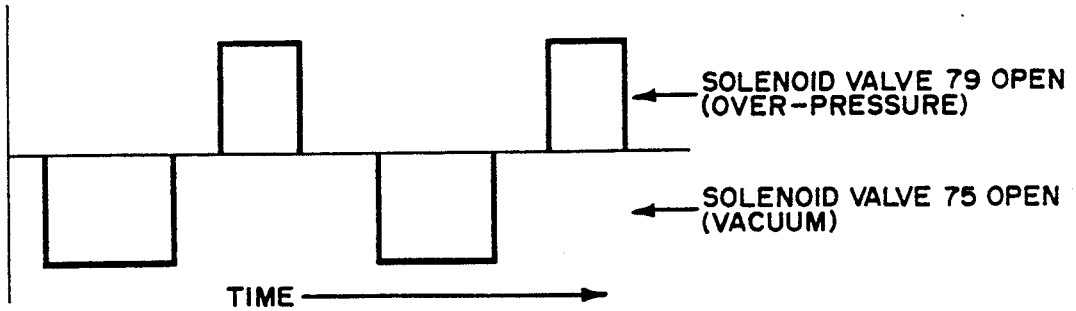
FIG. 7 is a graphical representation showing the time duration of the pressure vacuum cycle of the circulation enhancing boot of the subject invention.

Referring now to FIGS. 3, 6 and 7, potentiometers 44, 45 and 46 control the energization cycles of relay 71 and 73, and thus the time period which solenoid valves 75 and 79 are open. As shown in FIG. 7 potentiometers 44, 45 and 46 are set such that relay 71 is open for a longer time period than relay 73 thereby producing a vacuum time period cycle that is longer in duration then the pressure time cycle.

As shown in FIG. 6 there is a phase leg between the pressure of the human artery as sensed by transducer 39, and the pressure vacuum cycle in boot 11. This phase leg of approximately 180 degrees can be modified by changing the RC time constant of resistor 58 and capacitor 59. The magnitude of the over-pressure condition within boot 11 and the vacuum within boot 11 can be adjusted by adjusting valves 83, 87, 89 and 91 and the magnitude of the over-pressure and vacuum cycle can be read using gauge 33.

It should be noted that by contouring the shape of the element which encases an injured limb the features of the present invention may be modified to treat other injured extremities such as a frost bitten or crushed arm.

From the foregoing, it may readily be seen that the subject invention comprises a new, unique and exceedingly useful circulation enhancing boot which constitutes a considerable improvement over the knoW prior art.

Obviously, many modifications and variations of the present invention are possible in light of the above teachings. It is, therefore to be understood that within the scope of the appended claims, that the invention may be practiced otherwise than as specifically claimed.

What is claimed:

1. A device for augmenting blood circulation in a patent's injured foot comprising:

(a) an airtight boot adapted to encase said injured foot, said boot having an inlet outlet port;

(b) means attached to a corresponding leg of said patient and having an output for monitoring the arterial blood pressure of said leg and for providing an electrical signal indicative of the arterial blood pressure of said leg;

(c) means having an input and an inlet outlet port connected to the inlet outlet port of said airtight boot for cyclically supplying air to said boot to expel blood from said injured foot and then withdrawing air from said airtight boot to create a partial vacuum and thereby draw blood into said injured foot; and (d) circuit means for responding to the electrical signal provided by said monitoring means and thereby controlling the cycle by which said air supplying means supplies air to said boot and then withdraws air from said boot, said circuit means comprising:

an integrating amplifier having an input connected to the electrical output of said monitoring means, and an output;

a transistor having a base connected to the output of said integrating amplifier, an emitter and a collector;

a first diode having an anode connected to the emitter of said transistor and a cathode;

a second diode having a cathode connected to the emitter of said transistor and an anode;

a first relay having a coil connected to the cathode of said first diode and a normally open contact connected to the input of said air supplying means;

a second relay having a coil connected to the anode of said second diode and a normally open contact connected to the input of said air supplying means;

a positive direct current voltage source connected to the collector of said transistor; and a negative direct current voltage source connected to the emitter of said transistor.

2. The device of claim 1 wherein said monitoring means comprises a transducer.

3. The device of claim 1 wherein said air supplying means comprises:

(a) a first normally closed solenoid valve having a first terminal connected to the output of said circuit means, a second terminal, an inlet port, and an outlet port;

(b) a second normally closed solenoid valve having a first terminal connected to the output of said circuit means, a second terminal, an inlet port, and an outlet port: and (c) an alternating current voltage source connected to the second terminals of said first and second solenoid valves.

4. The device of claim 1 further characterized by a pressure transducer mounted on the inner surface of said boot and having an output connected to the input of said circuit means.

5. The device of claim 1 wherein said airtight boot is fabricated from plexiglass.

6. The device of claim 1 wherein said airtight boot is fabricated from fiberglass.

7. The device of claim 1 further characterized by a flexible hose connected between the inlet outlet port of said airtight boot and the inlet outlet port of said air supplying means, said flexible hose having a pressure gage.

8. The device of claim 1 further characterized by a filter connected between the inlet outlet port of said airtight boot and the inlet outlet port of said air supplying means.

9. The device of claim 1 further characterized by a pneumatic cuff attached to the inner surface of said airtight boot at the top thereof.

10. An apparatus for enhancing blood circulation in an injured human foot, said apparatus comprising:

(a) an airtight boot adapted to encase the injured foot, said boot having an inlet outlet port located thereon;

(b) a first transducer mounted on the inner surface of said boot, said first transducer having an electrical output;

(c) a second transducer attached to a corresponding leg above said boot, said second transducer having an electrical output;

(d) an integrating amplifier having an input connected to the electrical outputs of said first and second transducers, and an output;

(e) a transistor having a base connected to the output of said integrating amplifier, an emitter and a collector;

(g) a first diode having an anode connected to the emitter of said transistor and a cathode;

(h) a second diode having a cathode connected to the emitter of said transistor and an anode;

(i) a first relay having a coil connected to the cathode of said first diode and a normally open contact;

(j) a second relay having a coil connected to the anode of said second diode and a normally open contact;

(k) a positive direct current voltage source connected to the collector of said transistor;

(l) a negative direct current voltage source connected to the emitter of said transistor (m) a first normally closed solenoid valve having an input, an output connected to the normally open contact of said first relay, an inlet port, and an outlet port;

(n) a second normally closed solenoid valve having an input, an output connected to the normally open contact of said second relay, an inlet port, and an outlet port;

(o) an alternating current voltage source connected to the inputs of said first and second solenoid valves;

(p) a blower pump having an inlet port connected to the outlet port of said second solenoid valve and an outlet port connected to the inlet port of said first solenoid valve; and (q) a flexible hose having one end thereof connected to the inlet outlet port of said boot and the opposite end thereof connected to the outlet port of said first solenoid valve and the inlet port of said second valve.

11. The apparatus of claim 10 wherein said flexible hose has a pressure gage.

12. The apparatus of claim 10 further characterized by a first adjustable fluid flow restricting valve connected to the inlet port of said blower pump, a second adjustable fluid flow restricting valve connected to the outlet port of said blower pump, a third adjustable fluid flow restricting valve connected between the outlet port of said second solenoid valve and the inlet port of said blower pump and a fourth adjustable fluid flow restricting valve connected between the output of said blower pump and the inlet port of said first solenoid valve.

13. The apparatus of claim 10 wherein said blower pump comprises a plurality of muffin fans connected in series.

14. The apparatus of claim 10 further characterized by a potentiometer having a first terminal connected to said positive direct current voltage source, a second terminal connected to said negative direct current voltage source and a third terminal connected to the input of said integrating amplifier.

15. The apparatus of claim 10 further characterized by a first potentiometer connected between the electrical output of said first transducer and the input of said integrating amplifier and a second potentiometer connected between the electrical output of said second transducer and the input of said amplifier.

16. The apparatus of claim 10 further characterized by a filter having a first port connected to said hose and a second port connected to the outlet port of said first solenoid valve and the inlet port of said second solenoid valve.

17. The apparatus of claim 10 further characterized by a pneumatic cuff attached to the inner surface of said boot at the top thereof.

18. The apparatus of claim 10 wherein said boot is fabricated from plexiglass.

19. The apparatus of claim 10 wherein said boot is fabricated from fiberglass.

* * * * *